US005402810A

United States Patent [19]

Donley

[11] Patent Number: 5,402,810

[45] Date of Patent: Apr. 4, 1995

[54] PACIFIER STORAGE AND WASHING APPARATUS AND METHOD

[75] Inventor: Beth J. Donley, Pompano Beach, Fla.

[73] Assignee: J.J. Donley and Sons, Inc., Pompano Beach, Fla.

[21] Appl. No.: 140,510

[22] Filed: Oct. 25, 1993

Related U.S. Application Data

[63] Continuation-in-part of Ser. No. 53,722, Apr. 27, 1993, abandoned, which is a continuation of Ser. No. 913,372, Jul. 15, 1992, abandoned.

[51] Int. Cl.[6] ..... B08B 3/04

[52] U.S. Cl. ..... 134/135; 134/200; 134/201; 206/205; 206/207

[58] Field of Search ..... 13/117, 135, 201, 82, 13/200, 197; 206/208, 205, 207, 211, 212

[56] References Cited

U.S. PATENT DOCUMENTS

| | | | |
|---|---|---|---|
| 2,060,277 | 11/1936 | Butts | 134/135 |
| 2,413,858 | 1/1947 | Borgeat | 134/201 |
| 2,566,819 | 3/1951 | Baltsois | 134/135 |
| 2,620,812 | 12/1952 | Kiefer | 134/117 |
| 3,019,494 | 2/1962 | Horie et al. | 206/208 |
| 3,066,687 | 12/1962 | Rohmann | 134/148 |
| 3,121,438 | 2/1964 | Kennedy | 134/145 |
| 3,236,588 | 2/1966 | Emerson | 206/212 |
| 3,964,926 | 6/1976 | Westphal | 134/117 |
| 4,085,955 | 4/1978 | Salle | 134/117 |
| 4,714,086 | 12/1987 | Kishida | 134/135 |
| 4,813,538 | 3/1989 | Blackman | 206/205 X |
| 5,000,209 | 3/1991 | Mann | 134/201 |

FOREIGN PATENT DOCUMENTS

| | | | |
|---|---|---|---|
| 87797 | 11/1959 | Denmark | 206/212 |
| 851837 | 5/1953 | Germany | 206/205 |

*Primary Examiner*—Frankie L. Stinson
*Attorney, Agent, or Firm*—Oltman and Flynn

[57] ABSTRACT

Portable apparatus is provided for storing and cleaning pacifiers, including a vessel having a vessel opening for containing cleaning fluid, a pacifier storage and cleaner rack comprising a raised platform having a platform edge and sized to fit within the vessel, the platform having opening for permitting the passage of the cleaning fluid through the platform and alternatively with a through-hole with a diameter sized smaller than the pacifier's base with the through-hole preferably sized at approximately the same diameter as bulb portion, and optional support member connected to the platform adjacent to the platform edge for lifting the platform. The apparatus preferably includes a vessel lid having an outer lid edge, the vessel lid being connected to the support member adjacent to the outer lid edge. The apparatus also preferably includes a lid engaging mechanism for removably securing the lid over the vessel opening. A method is provided for storing and cleaning a pacifier including the steps of placing the pacifier bulb on the platform or alternatively positioning the pacifier bulb into the through-hole on the platform; inserting the platform into the vessel submerging the bulb within the fluid; connecting the lid to cover the vessel opening; and moving the vessel so that fluid flows over the pacifier, lifting the lid and platform away from the vessel and removing the pacifier from the platform.

9 Claims, 5 Drawing Sheets

PACIFIER STORAGE AND WASHING APPARATUS AND METHOD

This application is a continuation-in-part of U.S. patent Ser. No. 08/053,322, filed Apr. 27, 1993, now abandoned, which is a Continuation of U.S. patent Ser. No. 07/913,372, filed Jul. 15, 1992, now abandoned.

BACKGROUND OF THE INVENTION

1. Field of the Invention

The present invention relates generally to the field of children's pacifiers, and more specifically to an apparatus and method for conveniently storing and/or washing pacifiers, the apparatus including a vessel having an open top for containing cleaning fluid, and a vessel lid connected near its edge by a support member to an edge of a pacifier retaining platform sized to fit within the vessel and having openings for permitting the passage of cleaning fluid, the platform can include through-holes for supporting individual pacifiers and dividing walls for separating pacifiers. The method include the steps of placing the pacifier on the platform or into the through-holes, inserting the platform and pacifier into the vessel until the lid fits over the open top and closes the vessel, shaking the vessel so that the fluid splashes over the pacifier, lifting the lid and platform away from the vessel and removing the pacifier from the platform.

2. Description of the Prior Art

It is important that children's pacifiers be kept clean and sanitary so that the child does not contract a disease from the pacifier. Pacifiers are usually washed by hand in a sink or basin. A problem with this arrangement is that the child often travels with the mother to locations where there are no convenient facilities for performing such a cleaning operation. The mother might carry a jar of cleaning fluid with her, but would have to execute the awkward task of inserting the pacifier into the jar and manipulating it with her fingers. Then, having done this, she would have no convenient place to clean and dry her hands.

Various types of portable cleaning devices are found on the market, but none appear to be suited to storing and/or cleaning pacifiers. An example is a cleaning fluid container and dipping tray used to clean jewelry. The container is an open-topped can and the dipping tray is a perforated dish having a centrally-mounted perpendicular handle. This device is illustrated in FIG. 1. To use the container, one places the jewelry on the tray and, gripping the handle, dips the tray into the can and fluid. A problem with this device is that the central location of the handle obstructs the placement of a pacifier on the tray. The tray could not be made large enough to accept a pacifier without making the can inconveniently large and bulky. A second problem with this device is not allowing for the separation of each pacifier for storage purposes.

It is thus an object of the present invention to provide a cleaning container for pacifiers which is compact and portable.

It is another object of the present invention to provide such a container which can retain cleaning fluid without leakage when not in use and which remains sanitary.

It is another object of the present invention to provide a container for the safe storage of pacifiers.

It is still another object of the present invention to provide such a container which is safe, effective and easy to use.

It is finally an object of the present invention to provide such a container which is simple in design and reliable, and inexpensive to manufacture.

SUMMARY OF THE INVENTION

The present invention accomplishes the above-stated objectives, as well as other, as may be determined by a fair reading and interpretation of the entire specification.

A first apparatus is provided for cleaning a pacifier, including a vessel having a vessel opening for containing cleaning fluid, a pacifier retaining platform having a platform edge and sized to fit within the vessel and having a platform opening for permitting the passage of the cleaning fluid through the platform, and support member connected to the platform adjacent to the platform edge for lifting the platform. The apparatus preferably includes a vessel lid having an outer lid edge, the vessel lid being connected to the support member adjacent to the outer lid edge. The apparatus also preferably includes a lid engaging mechanism for removably securing the lid over the vessel opening, such as, where the vessel opening has a rim, where a tubular lip portion extends from the outer lid edge, and where the support member is spaced apart from the tubular lip portion sufficiently to permit the rim to pass between the support member and the tubular lip portion, where the engaging mechanism includes external screw threads on the vessel adjacent to the rim which engage internal screw threads provided inside the tubular lip portion.

A first method is provided of cleaning a pacifier using an apparatus including a vessel having a vessel opening and containing cleaning fluid, a vessel lid having a lid edge, a perforated platform having a platform edge, and a platform support member connected to the lid adjacent to the lid edge and to the platform adjacent to the platform edge, including the steps of placing the pacifier on the platform, inserting the platform into the vessel until the lid fits over the vessel opening and closes the vessel, moving the vessel so that the fluid flows over the pacifier, lifting the lid and platform away from the vessel and removing the pacifier from the platform.

A second apparatus is provided for storing and cleaning a pacifier, including a vessel having an opening for containing cleaning fluid, a pacifier rack comprising a raised platform having a platform edge and sized to fit within the vessel, the platform having an opening for permitting the passage of the cleaning fluid through the platform and a through-hole with a diameter sized smaller than the pacifier's base with the through-hole preferably sized to approximately fit the same diameter of the bulb portion, and optional support member connected to the platform adjacent to the platform edge for lifting the platform. The apparatus preferably includes a vessel lid having an outer lid edge, the vessel lid being connected to the support member adjacent to the outer lid edge. The apparatus also preferably includes a lid engaging mechanism for removably securing the lid over the vessel opening, such as, where the vessel opening has a rim, where a tubular lip portion extends from the outer lid edge, and where the support member is spaced apart from the tubular lip portion sufficiently to permit the rim to pass between the support member and the tubular lip portion, where the engaging mechanism includes either external screw threads on the vessel adjacent to the rim which engage internal screw threads provided inside the tubular lip portion or the engaging mechanism may include a snapable engaging means for holding the lid to the vessel rim.

A second method is provided for storing and/or cleaning a pacifier using an apparatus including a vessel having a vessel opening and containing cleaning fluid, a vessel lid having a lid edge, a perforated platform with through-holes having a platform edge, and a platform support member connected to the lid adjacent to the lid edge and to the platform adjacent to the platform edge, including the steps of positioning the pacifier bulb into the through-hole on the platform; inserting the platform into the vessel submerging the bulb within the fluid; connecting the lid to cover the vessel opening; and moving the vessel so that fluid flows over the pacifier.

BRIEF DESCRIPTION OF THE FIGURES

Various other objects, advantages, and features of the invention will become apparent to those skilled in the art from the following discussion taken in conjunction with the following drawings, in which.

DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. There, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numbers.

First Preferred Embodiment

Figure 1:
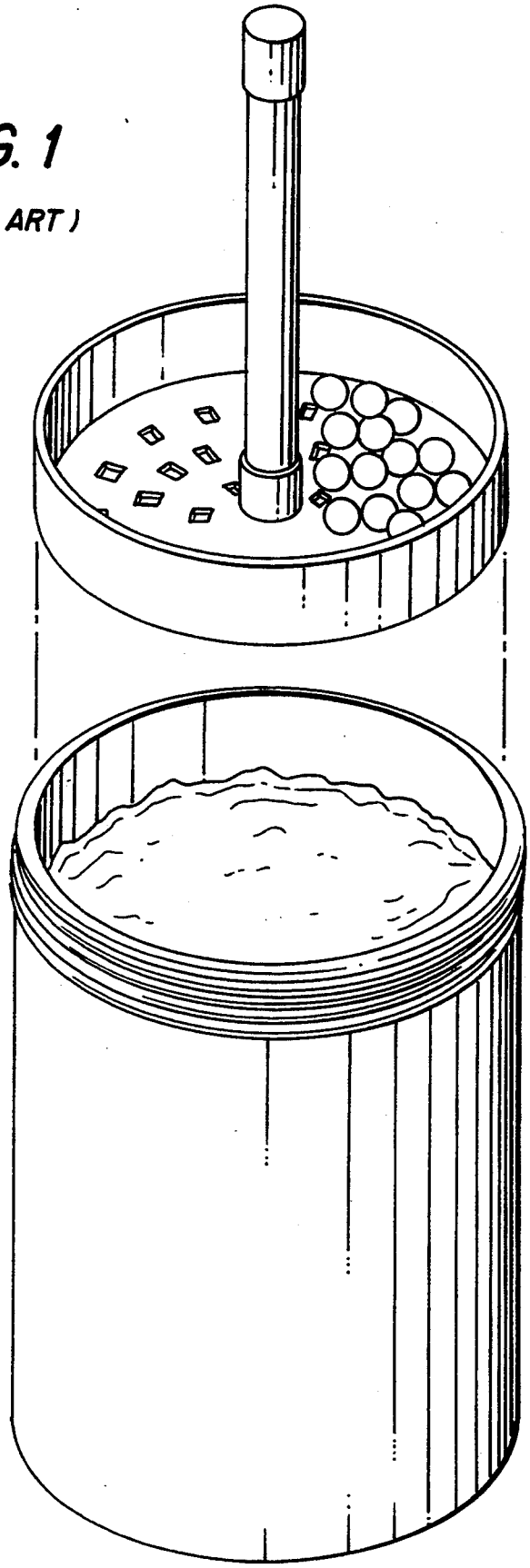
FIG. 1 (PRIOR ART)
FIG. 1 is a perspective view of a prior art device for cleaning jewelry, as discussed above in the description of the prior art.
Figure 2:
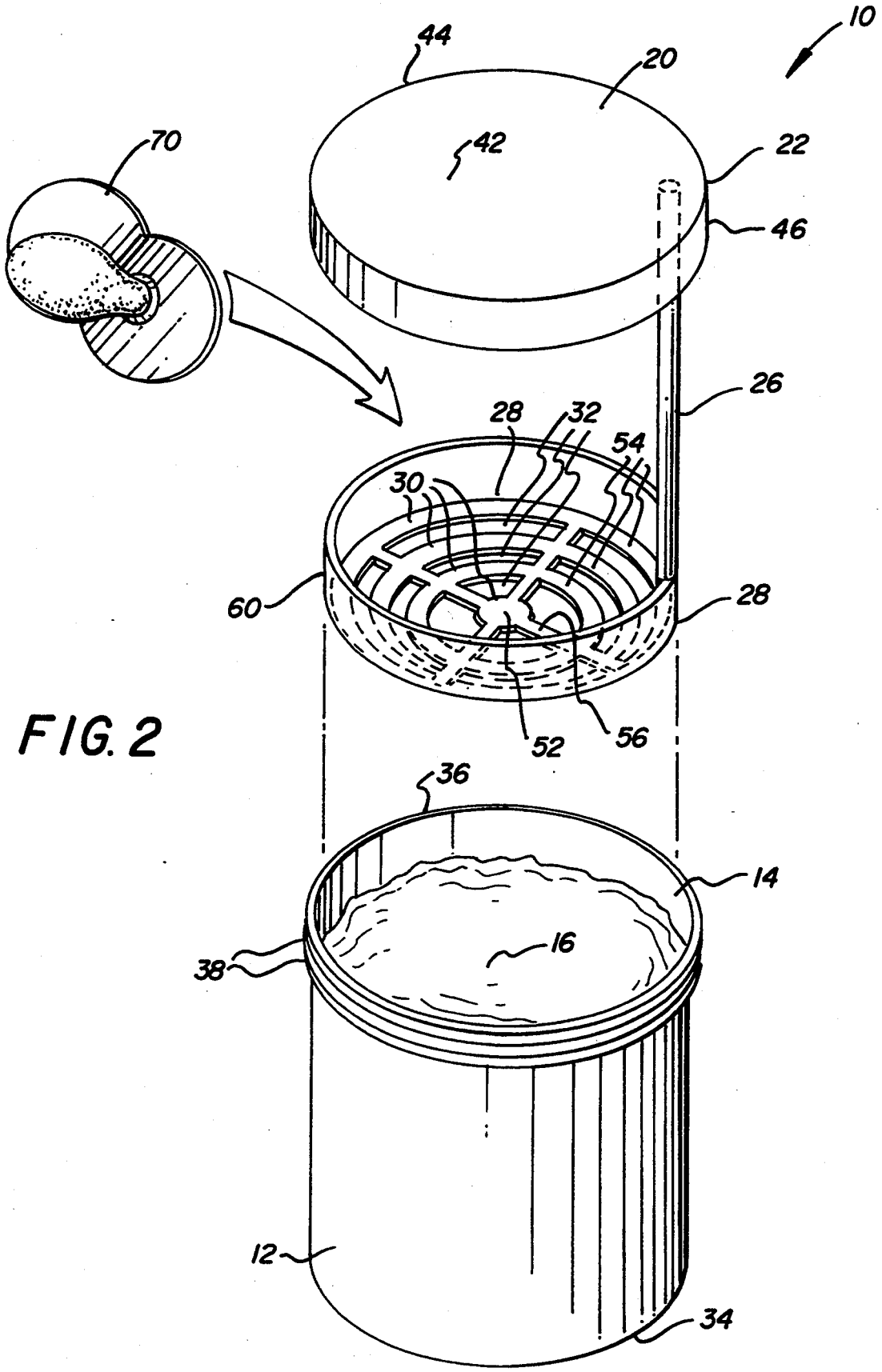
FIG. 2 is a perspective view of the first preferred embodiment of the inventive pacifier washing apparatus.

Referring to FIG. 2, a pacifier washer apparatus 10 is disclosed which includes a vessel 12 having a vessel opening 14 for containing a conventional cleaning fluid 16. A vessel lid 20 is also provided and is connected at its edge 22 by a support member 26 to an edge 28 of a pacifier retaining platform 30. Lid 20 and platform 30 each extend perpendicularly from support member 26 in the same direction. Platform 30 is sized to fit within vessel 12 and has openings 32 for permitting the passage of cleaning fluid 16 through platform 30.

Figure 3:
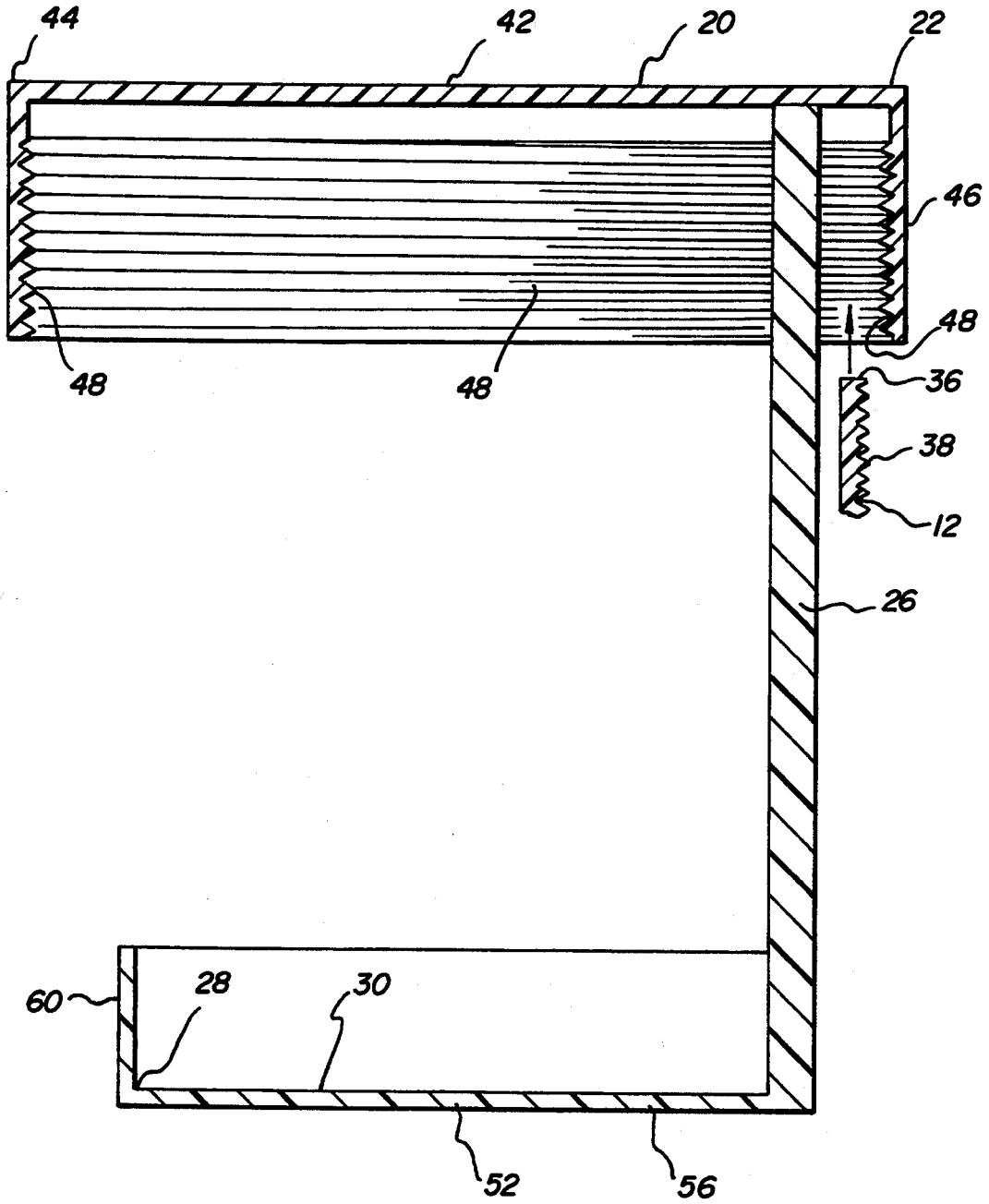
FIG. 3 is a cross-sectional side view of FIG. 2 of the lid, support member and platform, showing the space between the tubular lip portion of the lid and the support member, for receiving the rim of the vessel opening, and showing a fragment of the rim.

Vessel 12 is preferably a hollow circular cylinder having a bottom wall 34 and an upper rim 36 around vessel opening 14. See FIG. 2. An exterior screw thread 38 is preferably provided adjacent to upper rim 36. Lid 20 has a circular upper wall 42 connected at its edge 44 to a downwardly extending tubular lip portion 46. Screw thread 38 engages a corresponding interior screw thread 48 inside tubular lip portion 46. Support member 26 is spaced apart from edge 44 and tubular lip portion 46 by a sufficient distance to permit upper rim 36 of vessel 12 to pass between support member 26 and tubular lip portion 46. See FIG. 3.

Platform 30 preferably includes a central circular portion 52 surrounded by several spaced apart concentric circular portions 54, interconnected by radial spoke portions 56. The gaps between concentric circular portions 54, and between the innermost concentric circular portion 54 and the central circular portion 52, constitute openings 32. A cylindrical retaining wall 60 preferably extends upward from the outer edge 28 of the outermost concentric circular portion 54, for retaining the pacifier 70 on platform 30. Platform 30 may be perforated in many equivalent ways, may have only a single opening 32, or may be a screen section.

Vessel 12 and lid 20 are preferably made of transparent plastic, but may be formed of any suitable material. Support member 26 and platform 30 are also preferably made of plastic, but again, other suitable materials may be substituted. Although vessel 12 is described and illustrated as being a hollow circular cylinder, it equivalently may be elliptical, cubical, or any of many other shapes. Also, vessel opening 14 need not extend over the entire upper portion of vessel 12, and need not be located at the very top of vessel 12.

Method for First Preferred Embodiment

In practicing the invention, the following method may be used. Pacifier 70 is placed on platform 30, and platform 30 is inserted into vessel opening 14 until lid 20 fits over upper rim 36 and closes vessel 12. Vessel 12 is shaken or other wise moved so that cleaning fluid 16 splashes or simply flows over pacifier 70. Then lid 20 and platform 30 are lifted away from vessel 12 and pacifier 70 is removed from platform 30. Alternatively to shaking vessel 12, lid 20 may be raised and lowered relative to vessel 12, to raise and lower platform 30 and pacifier 70 in fluid 16, so that fluid 16 flows over pacifier 70.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

Second Preferred Embodiment

Figure 4:
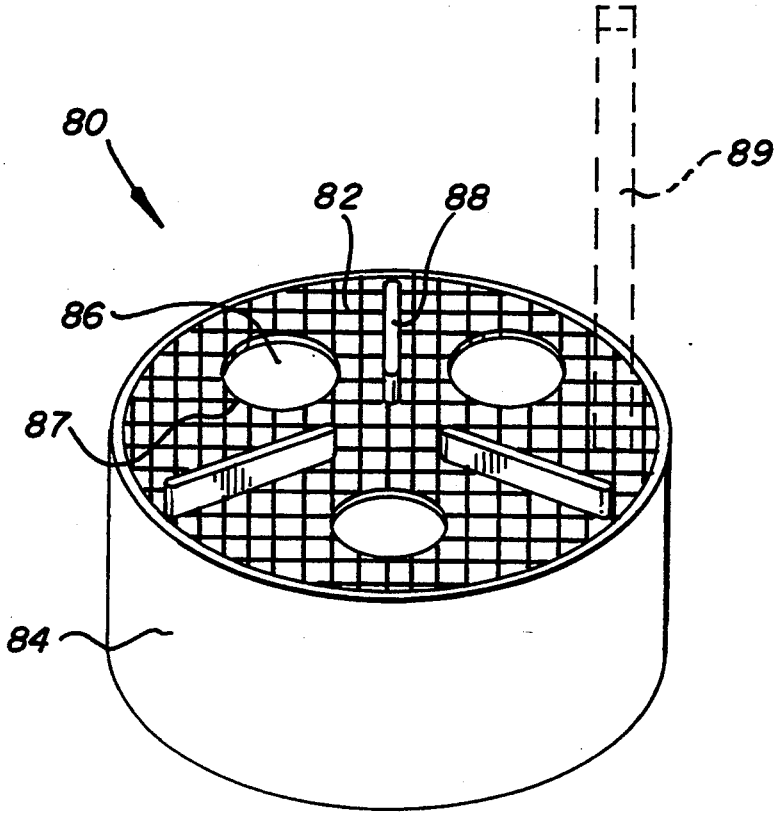
FIG. 4 is a perspective view of the pacifier storage and cleaning rack.
Figure 5:
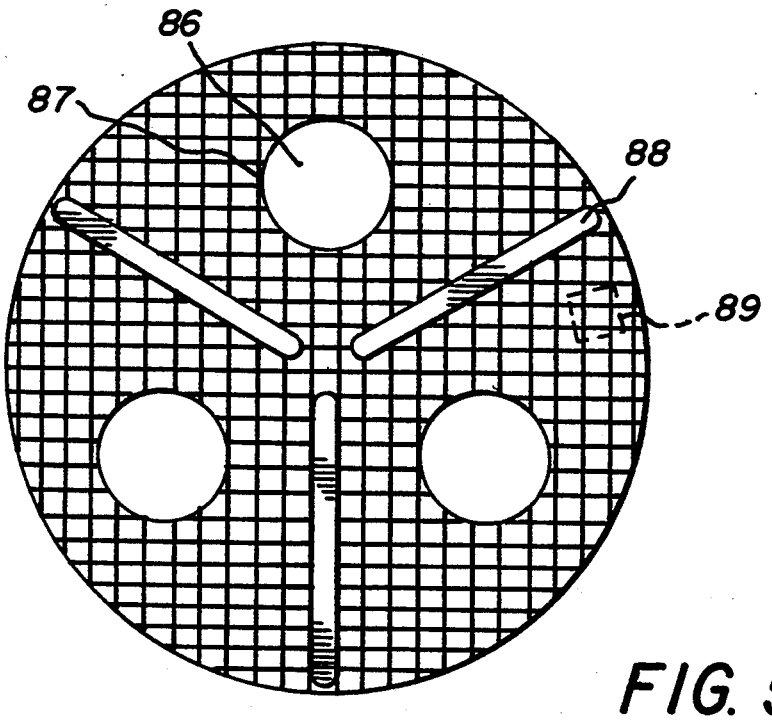
FIG. 5 is a top view of the pacifier storage and cleaning rack of FIG. 4.

Referring to FIG. 4, a pacifier storage and washing rack 80 is disclosed which includes a raised platform having openings 82 for permitting the passage of cleaning fluid, a cylindrical support 84 for raising the platform, through-holes 86 for receiving the bulb portions of pacifiers, rims 87 about the through-holes, separator/divider walls 88, and an optional support member 89 for raising and lowering the entire rack 80. FIG. 5 is a top view of the pacifier storage and washing rack 80 of FIG. 4.

Figure 6:
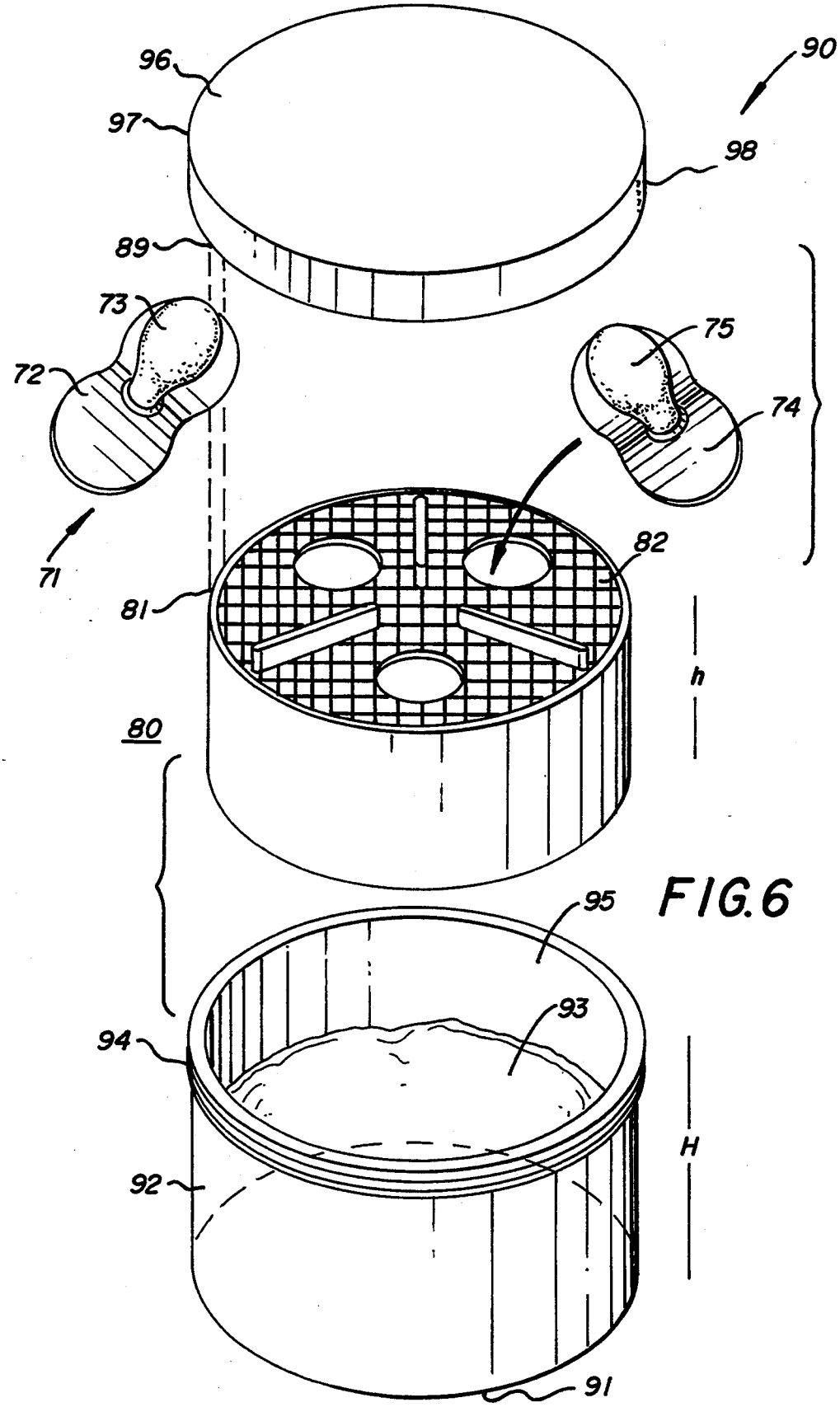
FIG. 6 is a perspective view of the second preferred embodiment of the inventive pacifier storage and washing apparatus.

Referring to FIG. 6, a pacifier storage and washing apparatus 90 is disclosed which includes a vessel 92 having a vessel opening 95 for containing a conventional cleaning fluid 93. A vessel lid 96 is also provided and is optionally connected at its edge 97 by the support member 89 to an edge 81 of the pacifier storage and cleaner rack 80. Rack 80 is sized to fit within vessel 92.

Vessel 92 is preferably a hollow circular cylinder having a bottom 91 and an upper rim 94 around vessel opening 14. See FIG. 6. Rim 94 of vessel 92 can include an exterior screw thread mateable to a corresponding interior screw thread 98 inside rim portion 97 of lid 96. Alternatively rim 94 can include snapable engaging means for holding lid 96 onto vessel rim 94.

Raised platform 82 preferably includes perforated openings such as screens or grates and their equivalents, or may have only a single opening for allowing the passage of cleaning fluid therethrough. Raised platform also includes at least one through-hole 86 for receiving a single pacifier. Through-hole 86 has a diameter sized to approximately fit the diameter of the bulb portion 73 of pacifier 71. The diameter of through-hole 86 is also preferably sized smaller than the expanded base portion 72 of pacifier 71. Preferably the through-holes 86 can be slightly smaller than the diameter of the bulb portions 73, 75 for creating a snug fit, or the through-holes 86 may be slightly larger than the diameter of the bulb portion 86. If more than one through-hole 86 is used, then divider walls 88 are useful for separating each through-hole from one another.

Vessel 92 and lid 96 are preferably made of transparent plastic, but may be formed of any suitable material. Raised platform 82, rim 87, divider wall 88 and optional support member 89 are preferably made of metal or plastic, but again, other suitable materials may be substituted. Although vessel 92 is described and illustrated as being a hollow circular cylinder, it equivalently may be elliptical, cubical, or any of many other shapes. Also, vessel opening 95 need not extend over the entire upper portion of vessel 92, and need not be located at the very top of vessel 92.

Method for Second Preferred Embodiment

In practicing the invention, the following method may be used. The bulb portion 73 of Pacifier 71 is positioned into through-hole 86 with the expanded base portion 72 of pacifier 71 resting against rim 87 of through-hole 86. Pacifier storage and washer rack 80 is inserted into vessel opening 95 until lid 96 fits over upper rim 94 and closes vessel 92. Vessel 92 is shaken or other wise moved so that cleaning fluid 93 splashes or simply flows over pacifier 71. Then lid 96 and rack 80 are lifted away from vessel 92 and pacifier 71 is removed. Preferably fluid level of cleaning fluid 93 is lower than the height of raised platform 82. Alternatively to shaking vessel 92, lid 96 may be raised and lowered relative to vessel 92 by optional support 89, to raise and lower rack 80 and pacifier 71 in fluid 93, so that fluid 93 flows over pacifier 71.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for storing and cleaning pacifiers, comprising:
   - a pacifier having a bulb with a diameter and having an enlarged base member with a diameter;
   - a pacifier supporting platform;
   - a through-hole in the platform with a diameter sized smaller than the diameter of the pacifier base member, the diameter of the through-hole sized to approximately fit the diameter of the bulb; and
   - a vessel having an opening for receiving the platform and having a vessel interior depth and containing a fluid for washing said pacifier;
   - a lid having an outer edge, said vessel lid being removably connected to a rim on the opening of the vessel;
   - a connection link member fixedly connecting said platform to said lid such that said platform is spaced apart from said lid a certain substantially fixed distance less than said vessel interior depth for positioning said platform and pacifier in said fluid when said lid is fitted against said rim.

2. An apparatus according to claim 1, additionally comprising mateable threads on the lid and the vessel rim.

3. An apparatus according to claim 1, additionally comprising snapable engaging means for holding the lid to the vessel rim.

4. An apparatus according to claim 1, wherein the platform is formed of material chosen from grating, screen, and mesh material.

5. An apparatus according to claim 1, wherein the platform further includes:
   - at least two through-holes.

6. An apparatus according to claim 5, wherein the platform further includes:
   - a dividing wall separating each hole from another hole.

7. An apparatus according to claim 1, wherein the through-hole further includes:
   - a rim with a diameter sized slightly smaller than the diameter of the bulb for a snug fit.

8. An apparatus according to claim 1, wherein the through-hole further includes:
   - a rim with a diameter sized approximately the same size as the diameter of the bulb.

9. An apparatus according to claim 1, wherein the through-hole further includes:
   - a rim with a diameter sized larger than the diameter of the bulb.

* * * * *